US006249221B1

(12) United States Patent
Reed

(10) Patent No.: US 6,249,221 B1
(45) Date of Patent: Jun. 19, 2001

(54) EMERGENCY DETECTOR DOOR ILLUMINATION ESCAPE SYSTEM

(76) Inventor: Joyce J. Reed, 530 Indian Hills Dr., Dayton, TN (US) 37321

( * ) Notice: Subject to any disclaimer, the term of this patent is extended or adjusted under 35 U.S.C. 154(b) by 0 days.

(21) Appl. No.: 09/362,529

(22) Filed: Jul. 28, 1999

(51) Int. Cl.[7] ..... G08B 1/08; G08B 5/00

(52) U.S. Cl. ..... 340/539; 340/531; 340/331; 340/332; 340/691.6; 340/286.05

(58) Field of Search ..... 340/539, 531, 340/331, 332, 540, 691.1, 691.6, 286.05, 307, 308, 815.73, 628

(56) References Cited

U.S. PATENT DOCUMENTS

| | | | | |
|---|---|---|---|---|
| 4,189,720 | * | 2/1980 | Lott | 340/539 |
| 4,283,657 | | 8/1981 | Gordon et al. | 340/628 |
| 4,417,235 | * | 11/1983 | Del Grande | 340/531 |
| 4,422,069 | | 12/1983 | Edstrom et al. | 340/691 |
| 4,450,436 | * | 5/1984 | Massa | 340/531 |
| 4,489,308 | | 12/1984 | Logan, Jr. et al. | 340/331 |
| 4,524,304 | | 6/1985 | Todd | 340/628 |
| 4,531,114 | | 7/1985 | Topol et al. | 340/628 |
| 4,612,535 | * | 9/1986 | Sequin et al. | 340/539 |
| 4,617,555 | * | 10/1986 | Sheiman | 340/531 |
| 4,649,376 | | 3/1987 | Frank | 340/691 |
| 4,763,115 | | 8/1988 | Cota | 340/628 |
| 4,801,928 | | 1/1989 | Minter | 340/332 |
| 5,177,461 | * | 1/1993 | Budzyna et al. | 340/331 |

* cited by examiner

*Primary Examiner*—Donnie L. Crosland
(74) *Attorney, Agent, or Firm*—Pitts & Brittian, P.C.

(57) ABSTRACT

An escape system for aiding a person in finding an exit door in the event of an emergency situation of limited visibility. The escape system can includes at least one heat detector and at least one smoke detector, an audible alarm circuitry, a dynamic pulsating door base light, and an optional continuous door base light. Upon detection of a threshold amount of heat or smoke by detectors, an audible detection signal is received by a remotely located microphone, and a alarm signal is generated for transmission by radio frequency (RF) by a RF transmitter. The alarm signal is received by a RF receiver located in an exit door alert unit, having associated circuitry for activating dynamic pulsating LED lights within the door alert unit. The illuminating and flashing LED lights attract the attention of a person in distress who may be crawling along the floor in a smoke-filled room, therefor assisting people to locate and exit a smoke filled and burning enclosure.

17 Claims, 4 Drawing Sheets

EMERGENCY DETECTOR DOOR ILLUMINATION ESCAPE SYSTEM

FIELD OF INVENTION

The present invention relates generally to the field of emergency escape systems, and more particularly to an alarm detector triggered visual indicator system for locating an exit during an emergency.

BACKGROUND OF INVENTION

Many lives are lost each year because people are trapped in burning indoor areas and are unable to locate an exit in heavy smoke. In many cases, fire alarms are properly activated and emergency exit signs are illuminated. However, typical alarms only warn that there is a fire or other emergency, not the location of an exit. There are conventional exit signs, but such are not typically associated and coordinated with an alarm system. Such emergency exit lights are usually placed over doors. Since smoke fills a room from the ceiling down, these lights are quickly obscured by smoke.

Typical of the art are devices which activate an exit light or a light near a door in the event of a fire or other emergency condition. In U.S. Pat. No. 4,801,929, issued to Minter, an egress detection system is disclosed that includes an indicator unit having at least three electroluminescent lamps in a linear arrangement near an exit with associated electrical circuitry in a control unit. The lamps are sequentially lit during an emergency, with actuation in response to a smoke alarm triggered electrical sensor that is electrically connected by electrical wiring to the control unit and to the lamps. The system is located near the smoke detector but not on the exit door due to electrical wiring limitation.

In U.S. Pat. No. 4,763,115, issued to Cota, a fire or smoke detection and alarm system is disclosed that is installed near an exit door. The system includes an enclosure that houses electrical circuitry for detection of smoke and/or fire, plus electrical connectors for actuation of a stroboscopic flashing lamp and an audio alarm that are located within the enclosure. The system can be installed at a wall position near the exit door, or as a free-standing unit for signaling in a smoke filled room.

In U.S. Pat. No. 4,649,376, issued to Frank, a visual fire alarm apparatus is disclosed that includes audible and portable visual alarms. The visual alarms include high intensity lamp units that are portable and mountable in a hallway or alternately immediately adjacent to the opposite sides of an exit door. The lamp units are located to create bursts of light beams below the normal lower smoke level in a room. A low voltage wiring system for electrical connection between the smoke detector and lamp units is required.

In U.S. Pat. No. 4,531,114, issued to Topol et al., an intelligent fire safety system is disclosed that includes exit sign units that receive communications from the central station unit that is coupled to a smoke sensor and a heat sensor. The system includes a speech synthesizer and a strobe light to provide alerting sounds and light to an occupant of a room in an emergency situation. The system can be coupled by electrical wiring or optic fibers to multiple floors for inter-floor alert messages.

In U.S. Pat. No. 4,524,304, issued to Todd, a smoke alarm activated portable light bulb is disclosed that is activated in response to the sound emitted by a smoke alarm device. The associated circuitry has filtering circuitry to ignore extraneous noise signals, has low battery drain features, and requires electrical connectors to actuate the light bulb.

In U.S. Pat. No. 4,489,308, issued to Logan et al., an emergency exit indicator system is disclosed that drops from a housing to illuminate an area beside a door. The system includes a light that is tethered at an elevated location above an emergency exit, with the strobe light dropped to a position suspended just above the floor when a smoke detector detects dangerous levels of smoke. The actuation circuitry is connected by electrical connectors to a nearby alarm indicator.

In U.S. Pat. No. 4,422,069, issued to Edstrom et al., a system for indicating an emergency exit is disclosed that includes flashing high intensity lights positionable near the floor at an exit. The lights are actuated by a fire detector device with nearby associated triggering circuitry connected to the detector by electrical connectors.

In U.S. Pat. No. 4,283,657, issued to Gordon et al., an exit illuminating system is disclosed that includes high intensity lights that are actuated by an emergency condition detector responsive to a power failure, smoke, and heat. The circuitry for actuation requires electrical connectors to a power supply and to smoke sensor for continuous monitoring and actuation.

However, none of the prior devices are positioned on the exit door or directly illuminates the base of the exit due to limitations in electrical connections with an exit door mounted unit. Rather, the devices illuminate an area near, above, or beside the exit. Thus, a person caught in a fire may be led to an area near an exit door but might then wander to the wrong side of the exit door or to an adjacent interior exit door, missing the exit door. A disoriented person may finally find the exit door after multiple seconds or after a minute. However, in a high heat and heavy smoke situation, a few seconds can be the difference between life and death. In addition, for a system to be truly effective, it must warn people in areas which have yet to be affected by the fire or other emergency condition.

Accordingly, there is a need for an improved detector actuated escape system that is activated by remote sensing of smoke or fire, and is configured to actuate self-contained, multiple light sources placed on a lower area of an exit door to illuminate the exit door in an emergency situation of poor visibility for a person crawling on the floor.

Therefore, it is an object of the present invention is to detect an emergency condition indoors by remote sensing of high heat or smoke accumulation.

It is another object of this invention to provide a light which illuminates an exit door base during an emergency situation of low visibility such as an indoor fire.

It is another object of the present invention to provide an audible alarm in case of an emergency situation of high background noise.

It is another object of the present invention to provide a light on the lower base of an exit that is highly visible through smoke and is self-contained.

It is another object of the present invention to provide a self-contained alarm signal receiver, power source, control circuitry, and a plurality of light in a unit mountable on any sized exit door.

SUMMARY OF INVENTION

In accordance with the present invention, an improved emergency detector exit door illumination escape system is disclosed to be used in conjunction with an exit door for aiding people in finding the exit door in the event of an emergency situation posing low visibility in a room, the exit door having a lower base.

The escape system comprises at least one sensor for detecting the occurrence of a selected emergency situation, and a sound sensor located in proximity to the at least one sensor. The sound sensor includes a radio frequency transmitter for sending a detection signal to remotely located audible alarm circuitry after detecting the occurrence of the selected situation. False signals can be filtered out by the audible alarm circuitry. The audible alarm circuitry triggers a coded radio frequency alarm signal for transmittal to a remotely located lighting circuitry mounted as a separate unit on an exit door. The lighting circuitry actuates at least one pulsating light source in a door alert unit attachable to the base of the exit door. Additional light sources can be added to the door alert unit for additional illumination of the exit door base. The door alert circuitry activates the pulsating lights and any additional lights for flashing of lights and illumination of the base of the exit door.

BRIEF DESCRIPTION OF DRAWINGS

The above mentioned features of the escape system will become more clearly understood from the following detailed description of the invention read together with the drawings in which.

DETAILED DESCRIPTION OF INVENTION

Figure 1:
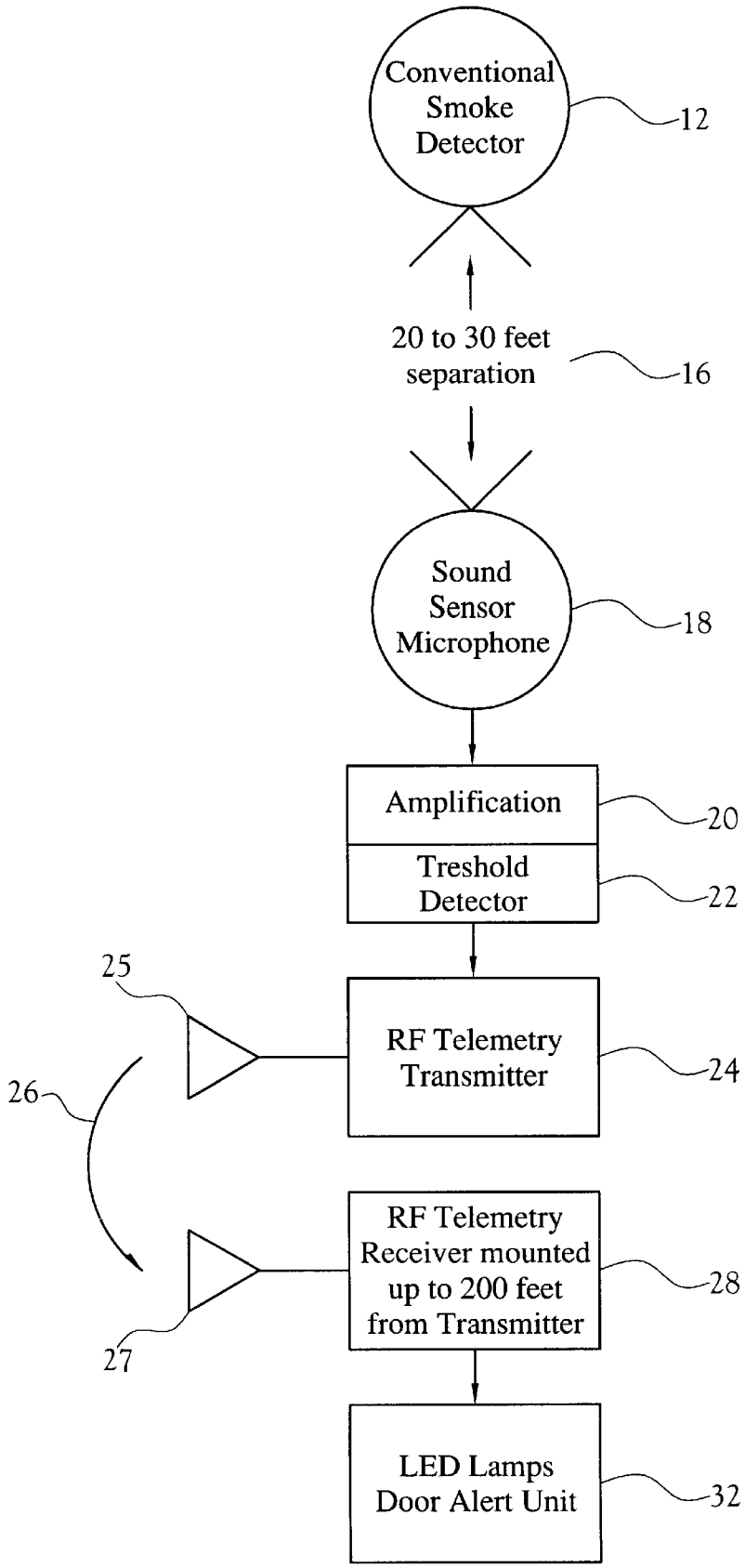
FIG. 1 is a block diagram of the escape system of the present invention showing the sound and radio frequency signal communications among the several components.

The objects and advantages of the smoke detector alarm actuated emergency detector exit door illumination escape system 10 are accomplished by the present invention which serves, in the event of a fire or other emergency, to illuminate the base of an exit door in a manner which will allow people caught in a fire or other emergency to easily find the exit door. In accordance with the various features of the invention, the escape system generally includes visual and audible alerts to notify people of the location of an exit door during an emergency situation. The escape system 10 employs a self-contained detector unit, a separate radio frequency (RF) transmission unit 24, with a remotely located RF receiver 28 and door alert unit 32 positioned on the base 76 of an exit door 74, with the option of multiple lights positioned in the door alert unit 32 on the exit door.

To activate the exit door alert unit lights and any optional lights in the event of an emergency, the escape system utilizes at least one detector such as smoke detector 12 and/or heat detector 14. A motion detector, carbon monoxide detector, or any other detector of heat or dangerous gases may also be used as a triggering device. When one or more of these detectors is activated, at least one audible alarm is activated in a continuous or repetitive mode, that is audible within approximately 20 to 30 feet of the detectors.

One embodiment of the escape system 10 incorporates multiple detection and warning features as illustrated in FIGS. 1–4. The escape system 10 comprises multiple detection units which sense emergency conditions within a room, hall, stairway, or other indoor enclosure. The detection units can include detectors 12, 14 which issue an audible detection signal 16 (see FIG. 1). The audible detection signal 16 is detected by a remotely located sound sensor 18, such as a piezo-transducer microphone that may be located approximately 20 to 30 feet away from the detectors 12, 14. The sound sensor 18 can be packaged together with amplification circuitry 20, threshold detection circuitry 22, in a RF transmission unit 24. The threshold detection circuitry 22 analyzes for below threshold detection signals or anomaly signals, and digitizes the detection signal 16 for transmission as a coded digital RF alarm signal 26. A delay circuitry (not shown) can be included after the sound sensor 18 to allow transmission delay by a preselected amount of time, approximately ten seconds, of generation of the alarm signal 26. This allows for rejection of false triggering sounds that are generated by transient loud sources of noise.

Figure 2:
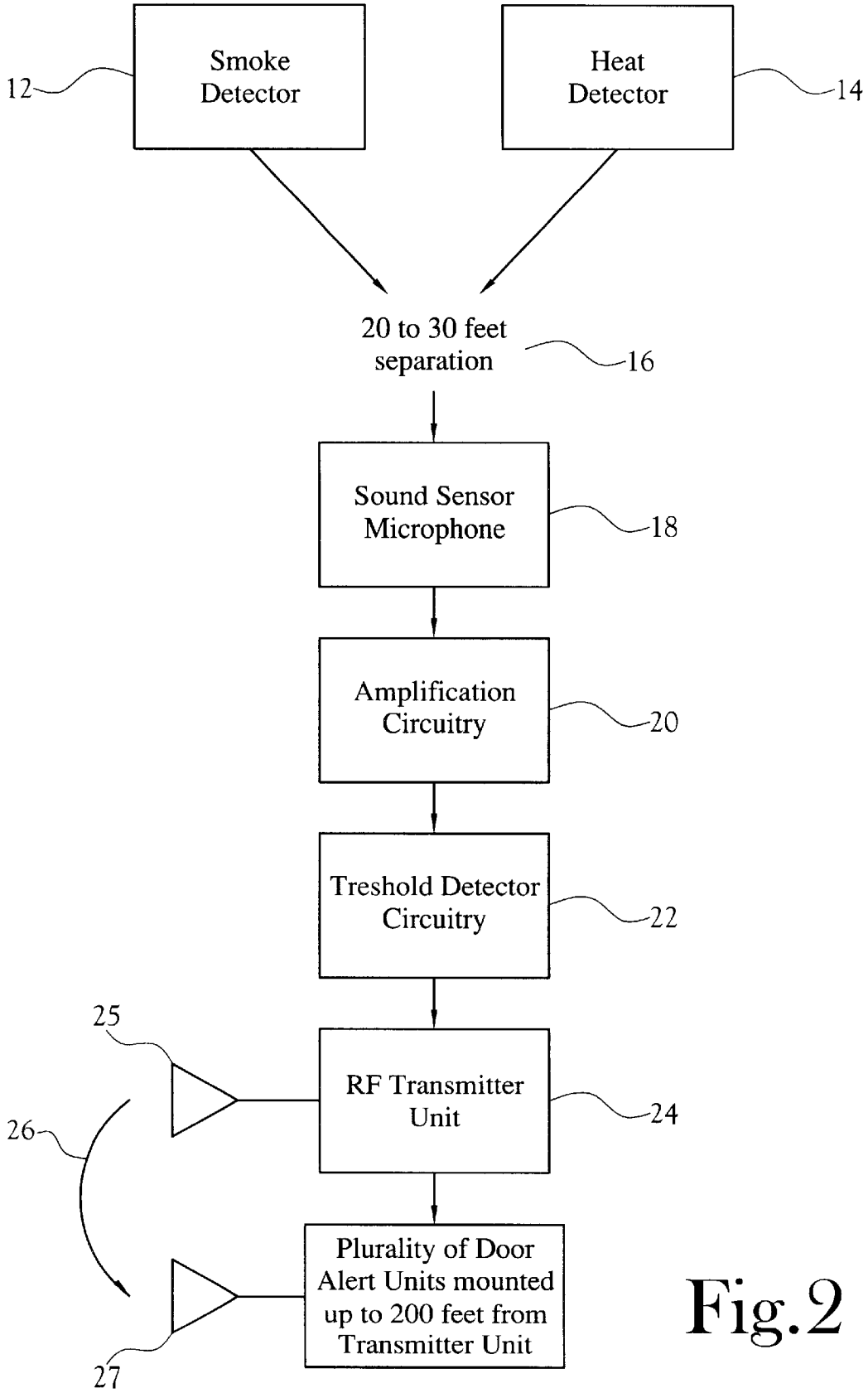
FIG. 2 is a block diagram of another embodiment of the present invention showing the sound and radio frequency signal communications with a plurality of door alert units placed on exit doors.

The RF transmission unit 24, shown in FIGS. 1–2, includes at least one RF transmitter that transmits the alarm signal 26 from the unit 24 for a distance of from approximately 1 foot to approximately 200 feet, which is the reasonable range of the radio frequency link depending on building construction. The transmission unit 24 can convert the detection signal 16 into a coded RF alarm signal 26 similar to a garage door coded signal, for transmission from a transmission antenna 25. The coded signal reduces the triggering of other alarm systems in adjacent buildings, in case the fire or smoke detected is localized in one building.

A RF receiver antenna 27 and receiver 28, or a plurality of receivers, can be located at one or more locations throughout the building that the exit door illumination escape system 10 is designed for. This allows the detectors 12, 14 to be placed in locations remote from the primary one or two exit doors 74 within a floor of a building.

Figure 3:
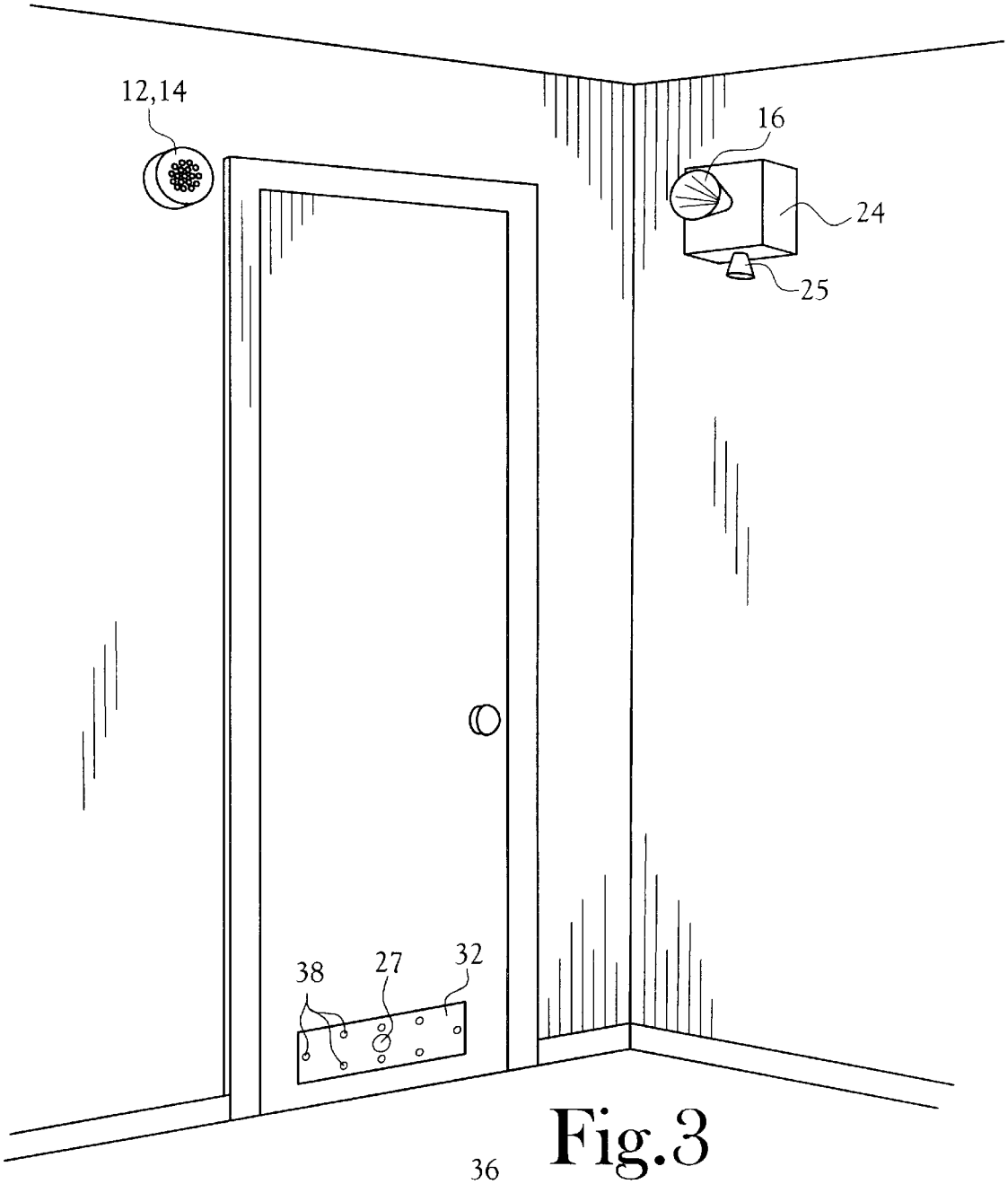
FIG. 3 is a perspective view of the escape system as installed, illustrating multiple LED lights within the door alert base unit.
Figure 3A:
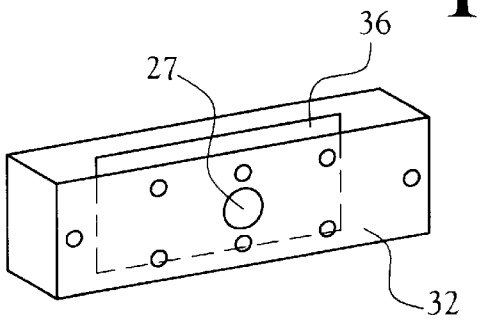
FIG. 3*a* is an exploded view of FIG. 3, illustrating the door alert base unit.

After alarm signal 26 is transmitted, it is received and decoded by RF receiver 28, with conversion into an uncoded alarm signal 34. The RF receiver 28 is mounted on, and the associated circuitry 36 is mounted in each self-contained door alert unit 32 that can be mounted on an exit door 74, preferably at the base 76 of the exit door (FIGS. 3 and 3*a*). The uncoded alarm signal 34 is conveyed by electrical circuitry 36 within the door alert unit 32 to activate a plurality of dynamic pulsating lights 38 that are located in the door alert unit 32.

Figure 4:
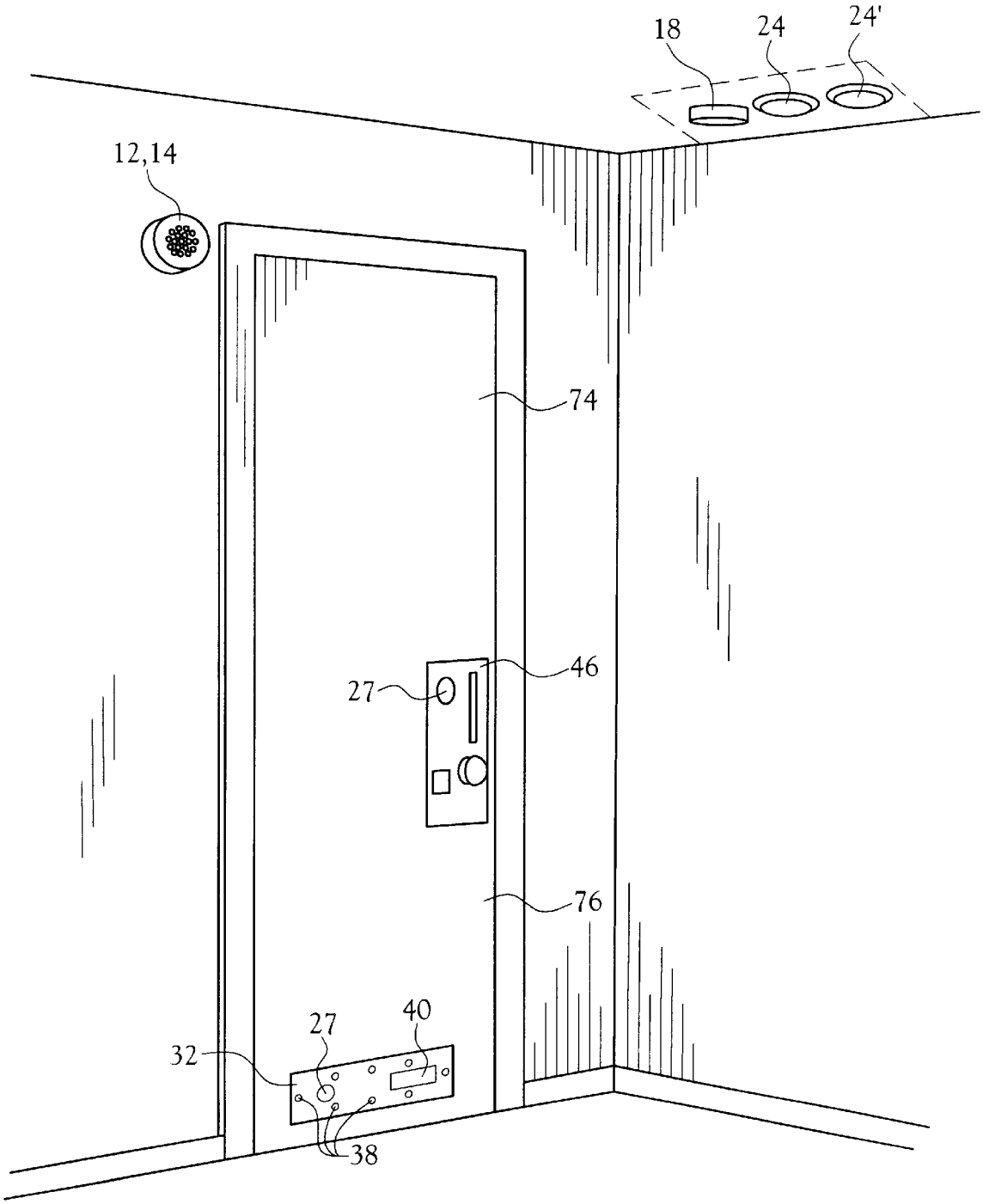
FIG. 4 is a perspective view of the escape system as installed, illustrating the door alert unit, and an optional door handle alert unit.

The door alert unit 32 is a removably attachable enclosure for connection to the base 76 of an exit door 74 by screw connectors or velcro type of fasteners, or for removable placement within an enclosure in the door base 76. The door alert unit 32 can be substantially covered by a base light cover 42, as shown in FIG. 4, which is fabricated from translucent material. The door alert unit 32 can be approximately three inches wide by approximately five inches long by approximately an inch deep in overall dimensions. The small size of the door alert unit 32 allows the activated lights to be seen during an emergency situation while preserving the aesthetics of the exit door 74 during non-emergency situations.

Preferably, the dynamic base lights 38 include light emitting diodes (LEDs), xenon high-intensity lights, or comparable lights that flash intermittently with intense light that can penetrate dense smoke. The LED lights 38 may be oriented in an approximately 8 diode to greater than 20 diode light arrangement to attract the attention of a person through dense smoke.

In an alternate embodiment a static or continuously emitting base light 40 can be included in the door alert unit 32 (see FIG. 4). The continuous base light 40 can be a conventional light that provides the same color, or a different wavelength of light for steady illumination of the door base 76 when activated by the exit door alert circuitry 36 within the door alert unit 32.

In one preferred embodiment, the coded alarm signal 26 is conveyed by at least one RF transmission unit 24 from a transmission antenna 25 with detection by a plurality of receiver antennas 27 of RF receiver units 28' coupled respectively to a plurality of associated decoding circuitry 30' located in a plurality of door alert units 32' that are located in, or on a multitude of exit door bases 76', throughout a building structure. Each decoding circuitry 30 analyzes the received RF transmitted alarm signal 26 and activates each respective set of LED dynamic lights 38 for illuminating and attracting attention to each respective exit door base 76. The activated lights, dynamic 38 and continuous 40 (if provided) remain on until the detection signal 16 ceases from the detectors 12, 14, and associated alarm signals 26 from RF transmission unit 24 end, or the door alert unit 32 is destroyed by heat.

As an additional benefit, the dynamic base light 38 and the optional continuous light 40 can utilize colored lights which penetrate dense smoke, such as the visible light of red wavelength and/or high intensity white light, which are commonly used for emergency notification signs to catch a distressed person's attention.

Before the escape system 10 is activated, the sound sensor 18 and associated circuitry 20, 22 cycles on/off for a repetitive timed cycle, to allow the sound sensor components to reduce the power demands on the batteries by the detection circuitry 20, 22. The detected signal 16 can cycle through a delay circuitry (not shown). If the detection signal 16 persists past the delay time, approximately ten seconds, the detection signal 16 then passes to the threshold circuitry 22 for coding and to the RF transmitter 24, for broadcast as a coded alarm signal 26. Once transmitted, alarm signal 26 can be received by each exit door base RF receiver 28, with associated base light decoding circuitry 30 generating a decoded alarm signal within each door alert unit 32, for energizing the lights 38, 40 (if included) of each door alert unit 32. With the pulsating dynamic LED lights 38 activated, the lights are typically directed beneath any smoke in the room, are visible to occupants crouched on the floor below the smoke, and therefore assist the occupants in finding the exit door base 76 to facilitate escape from the room.

ALTERNATIVE EMBODIMENTS

In an alternate embodiment, the detection signals 16 are received by a remotely located microphone 18 and the detection signals are processed by piezo-transducers, with associated amplification and generation of radio frequency (RF) alert signals 26, that are transmitted as coded RF alert signals 26 to multiple RF receivers 28' mounted up to approximately 200 feet from multiple RF transmitters 24'. The receipt of the alert signals 26 activates secondary, tertiary, or additional circuitry (not shown), that can actuate additional LED pulsating lights 38 and LED continuous lights 40 in a plurality of door alert units 32' on all exit door base panels 76 within the range of the RF transmitters. The redundant RF transmitters and multiple RF receivers provide the additional security of early notification of occupants of areas of a building that are not in immediate sight or smell of the fire and smoke during a developing emergency situation.

In another alternate embodiment, the dynamic base light 38, and base light circuitry 36 are carried in a door base light unit 32, which is combined to operate in concert with an optional, self-contained, exit door handle light unit 46 having pulsating dynamic lights and an optional continuous handle light (not shown). The transmitted RF alert signals are received by the door alert unit 32, and the separate RF receiver and decoding circuitry of the door handle light unit 46 for dual illumination of the exit door base and of the door handle to assist occupants of a smoke filled room to crawl to the proper exit door, and to locate the handle in as little time as possible for expedient exit from the room.

While a preferred embodiment is shown and described, it will be understood that it is not intended to limit the disclosure, but rather it is intended to cover all modifications and alternate methods falling within the spirit and the scope of the invention as defined in the appended claims. One skilled in the art will recognize variations and associated alternative embodiments. The foregoing description is exemplary in nature and the spirit and scope of the appended claims should not be limited to the description of the embodiment of the invention contained herein.

What is claimed is:

1. An escape system for alerting and aiding people in finding an exit door in a building in the event of an emergency situation of low visibility and/or fire within a building, said escape system comprising:

at least one detector for detecting the occurrence of the emergency situation;

detection signals broadcasted by said at least one detector after detecting the emergency situation;

an alarm receiver unit located proximate the site of the emergency situation, having an audible alarm receiver for detecting said broadcasted detection signals;

threshold detection circuitry associated with said alarm receiver unit, said circuitry analyzes said detection signal for false detection signals, and said circuitry digitizes said detection signal in radio frequency coded format;

at least one alarm signal generated by said threshold detection circuitry, said alarm signal generated in radio frequency coded format by said threshold detection circuitry;

a radio frequency transmission unit associated with said alarm receiver unit, said transmission unit transmits said at least one alarm signal;

a door alert unit releasably positionable on the exit door;

a radio frequency receiver unit associated with said door alert unit, said radio frequency receiver receives said alarm signal;

decoding circuitry associated with said door alert unit, said decoding circuitry decodes said at least one alarm signal; and at least one light source positioned in said door alert unit, said at least one light source emits a high intensity light when said at least one alarm signal is decoded by said decoding circuitry;

whereby people in the immediate vicinity of the emergency situation are guided to the exit door.

2. The escape system of claim 1, wherein said door alert unit is releasably positionable proximate the base of the exit door.

3. The escape system of claim 2, wherein said threshold detection circuitry further comprises delay circuitry, said delay circuitry receives said detection signals from said alarm receiver unit and delays generation of said alarm signal for a preselected amount of time.

4. The escape system of claim 3, wherein said at least one light source further comprises a plurality of LED lights positionable in said door alert unit, said plurality of LED lights are capable of emitting pulsating light signals upon receipt of said alarm signal.

5. The escape system of claim 4, wherein said at least one light source further comprises a second light positionable in said door alert unit, said second light source is capable of emitting continuous light signals upon receipt of said alarm signal.

6. The escape system of claim 5, wherein said audible alarm receiver further comprises a microphone for receipt of said detection signals.

7. The escape system of claim 6, wherein said radio frequency receiver unit further comprises a second door alert unit including a second radio frequency receiver unit disposed proximate the base of another exit door for receiving said at least one alarm signal, said second radio frequency receiver unit having decoding circuitry for decoding of said at least one alarm signal, said decoding circuitry sending said alarm signal to at least one light source of said second door alert.

8. An escape system to be used in conjunction with an exit door for aiding people in finding the exit door in a building in the event of an emergency situation, the exit door having an associated exit door base, said escape system comprising:

at least one detector for detecting the occurrence of the emergency situation;

detection signals broadcasted by said at least one detector after detecting the emergency situation;

an alarm receiver unit located proximate the site of the emergency situation, having an audible alarm receiver for detecting said broadcasted detection signals;

threshold detection circuitry associated with said alarm receiver unit, said circuitry analyzes said detection signal for false detection signals, and said circuitry digitizes said detection signal in radio frequency coded format;

at least one alarm signal generated by said threshold detection circuitry, said alarm signal generated in radio frequency coded format by said threshold detection circuitry;

a radio frequency transmission unit associated with said alarm receiver unit, said transmission unit transmits said at least one alarm signal;

a door alert unit releasably positionable on the exit door;

a radio frequency receiver unit associated with said door alert unit, said radio frequency receiver receives said alarm signal;

decoding circuitry associated with said door alert unit, said decoding circuitry decodes said at least one alarm signal;

at least one first light source in said door alert unit, said first light source emits pulses of high intensity light when said alarm signal is decoded by said decoding circuitry; and at least one second light source in said door alert unit, said second light source emitting continuous light when said alarm signal is decoded by said decoding circuitry;

whereby people in the immediate vicinity of the emergency situation are guided to the exit door.

9. The escape system of claim 8, wherein said door alert unit is releasably positionable proximate the base of the exit door.

10. The escape system of claim 9, wherein said threshold detection circuitry further comprises delay circuitry, said delay circuitry receives said detection signals from said alarm receiver unit and delays generation of said alarm signal for a preselected amount of time.

11. The escape system of claim 10, wherein said at least one first light source further comprises a plurality of LED lights positionable in said door alert unit, said plurality of LED lights are capable of emitting pulsating light signals upon receipt of said alarm signal.

12. The escape system of claim 10, wherein said at least one second light source further comprises said continuous light emits visible light in the red wavelength.

13. An escape system to be used in conjunction with an exit door for aiding people in finding the exit door in a building in the event of an emergency situation, the exit door having an associated exit door base, said escape system comprising:

at least one detector for detecting the occurrence of the emergency situation;

detection signals broadcasted by said at least one detector after detecting the emergency situation;

a plurality of alarm receiver units, each located proximate the site of the emergency situation, each having an audible alarm receiver for detecting said broadcasted detection signals;

threshold detection circuitry associated with each of said alarm receiver units, said circuitry analyzes said detection signal for false detection signals, and said circuitry digitizes said detection signal in radio frequency coded format;

at least one alarm signal generated by said threshold detection circuitry, said alarm signal generated in radio frequency coded format by said threshold detection circuitry;

a radio frequency transmission unit associated with each of said alarm receiver units, said transmission unit transmits said at least one alarm signal;

a plurality of door alert units, each door alert units releasably positionable respectively on multiple exit doors;

a radio frequency receiver unit associated with each of said door alert units, said radio frequency receiver receives said alarm signal;

decoding circuitry associated with each of said door alert units, said decoding circuitry decodes said at least one alarm signal;

at least one first light source in each of said door alert units, said first light source emits pulses of high intensity light when said alarm signal is decoded by said decoding circuitry; and at least one second light source in each of said door alert units, said second light source emitting continuous light when said alarm signal is decoded by said decoding circuitry;

whereby people in the immediate vicinity of the emergency situation are guided to the exit door.

14. The escape system of claim 13, wherein each of said door alert units is releasably positionable proximate the base of the exit door.

15. The escape system of claim 14, wherein said threshold detection circuitry further comprises delay circuitry, said delay circuitry receives said detection signals from said alarm receiver unit and delays generation of said alarm signal for a preselected amount of time.

16. The escape system of claim 15, wherein each of said at least one first light source further comprises a plurality of LED lights positionable in each of said door alert units, said plurality of LED lights are capable of emitting pulsating light signals upon receipt of said alarm signal.

17. The escape system of claim 16, wherein each of said at least one second light source further comprises said continuous light emits visible light in the red wavelength.

* * * * *